US006176383B1

(12) United States Patent
Lafond et al.

(10) Patent No.: US 6,176,383 B1
(45) Date of Patent: Jan. 23, 2001

(54) BIOLOGICAL SPECIMEN CASSETTE

(75) Inventors: André Lafond, St-Hilaire; Yanick Bertin, Verchères, both of (CA)

(73) Assignee: 3088081 Canada Inc., Quebec (CA)

( * ) Notice: Under 35 U.S.C. 154(b), the term of this patent shall be extended for 0 days.

(21) Appl. No.: 09/382,305

(22) Filed: Aug. 24, 1999

(51) Int. Cl.[7] ..... B65D 21/02

(52) U.S. Cl. ..... 220/23.86; 206/499; 206/758; 206/762

(58) Field of Search ..... 206/718, 499, 206/758, 762; 220/23.86

(56) References Cited

U.S. PATENT DOCUMENTS

| | | | | |
|---|---|---|---|---|
| 842,595 | * | 1/1907 | Vasconcelles | 206/499 |
| 1,134,525 | * | 4/1915 | Gallagher | 206/499 |
| 2,949,184 | * | 8/1960 | Lehner et al. | 206/718 |
| 3,144,016 | * | 8/1964 | Basci | 206/499 |
| 3,180,489 | * | 4/1965 | McGinn | 206/499 |
| 3,454,154 | * | 7/1969 | Peters et al. | 206/718 |
| 3,721,339 | * | 3/1973 | Seyer | 206/499 |
| 3,722,671 | * | 3/1973 | Wright et al. | 206/499 |
| 4,220,252 | | 9/1980 | Beall et al. | 220/307 |
| 4,421,246 | | 12/1983 | Schultz et al. | 220/307 |
| 4,483,441 | * | 11/1984 | Akizawa et al. | 206/499 |
| 4,917,854 | * | 4/1990 | Cole | 206/499 |
| 4,997,100 | | 3/1991 | Dudek | 220/306 |
| 5,509,574 | * | 4/1996 | Lenz et al. | 220/23.86 |

FOREIGN PATENT DOCUMENTS

| | | | | |
|---|---|---|---|---|
| 121732 | * | 3/1948 | (CH) | 206/499 |

* cited by examiner

*Primary Examiner*—Joseph M. Moy
(74) *Attorney, Agent, or Firm*—Merchant & Gould P.C.

(57) ABSTRACT

A biological specimen cassette adapted to be installed with similarly constructed cassettes as a package in a cassette dispenser from which cassettes are thereafter dispensed individually comprises a channel formed in at least one of its walls to receive a connecting element, such as band, string or wire, which, when engaged to all cassettes, form a collective stacked arrangement of cassettes which is insertable into the cassette dispenser. Once received in the dispenser, the connecting element is then retrieved so that individual cassettes may be individually dispensed.

12 Claims, 4 Drawing Sheets

BIOLOGICAL SPECIMEN CASSETTE

FIELD OF THE INVENTION

The present invention relates to a biological specimen cassette suitable for securing a biological tissue specimen so that the tissue can be subsequently sliced into thin sections on a microtome for subsequent microscopic examination. More particularly, the present invention relates to such biological specimen cassette so constructed as to be installed with similarly constructed cassettes as a package in a cassette dispenser from which cassettes may be dispensed individually.

BACKGROUND OF THE INVENTION

Cassettes for processing biological specimens are well known. For example, they may be found described in U.S. Pat. No. 4,220,252 issued Sep. 2, 1990 to Beall et al., U.S. Pat. No. 4,421,246 issued Dec. 20, 1983 to Schultz et al. and U.S. Pat. No. 4,997,100 issued Mar. 5, 1991 to Dudek.

These cassettes are formed of a body having a perforated bottom wall, opposite side walls, a front wall and a rear wall. Once a specimen is placed in a cassette, a lid is secured to the cassette to house the specimen.

Prior to being used for receiving a biological specimen, these cassettes are individually stacked in a vertical cassette loader with an open bottom from which they are collected individually. Data pertaining to the specimen contained in the lidded cassette is printed on the front wall of the cassette.

One problem associated with this method of stacking cassettes in the loader is that the cassettes must be individually placed in the loader by an operator, the operation being time consuming and, often, time is lost re-adjusting a cassette which may be improperly lodged in the loader (one reason being that the cassettes are in an oblique position in the loader).

OBJECTS AND STATEMENT OF THE INVENTION

It is an object of the present invention to provide a biological specimen cassette which is adapted to be installed with similarly constructed cassettes as a package in a cassette dispenser loader from which cassettes may be retrieved individually thereby avoiding the problems associated with the present method of individually placing cassettes in cassette dispenser loaders.

This is achieved by forming, prior to insertion in the cassette loader, a collective stacked arrangement of similarly constructed cassettes which are interconnected by a connecting element, such as a band, string or wire, so that they may be placed in the loaders of the dispenser as a unitary group. Once the group is in place, the connecting element is retrieved so that the cassettes may thereafter be dispensed individually from the bottom of the loaders.

The present invention therefore relates to a biological specimen cassette adapted to be installed with similarly constructed cassettes as a package in a cassette dispenser from which cassettes may be dispensed individually. The cassette comprises: a body having a perforated bottom from which extend front, rear and side walls; at least one of the walls displays a downward channel extending therealong; the channel has an open top and an open bottom so as to slidably receive therethrough a connecting element for forming, with similarly constructed cassettes, a collective stacked arrangement of cassettes whereby a plurality of cassettes connected by the element extending through the channel of each cassette may be collectively inserted into a cassette dispenser loader; the connected element is thereafter retrieved to form a stack of separate cassettes which are individually dispensable from the loader.

In one preferred form of the invention, as the cassettes are usually lodged at an angle with respect to the dispenser loader, the channel also extends at an angle with respect to the plane of the wall of the cassette.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
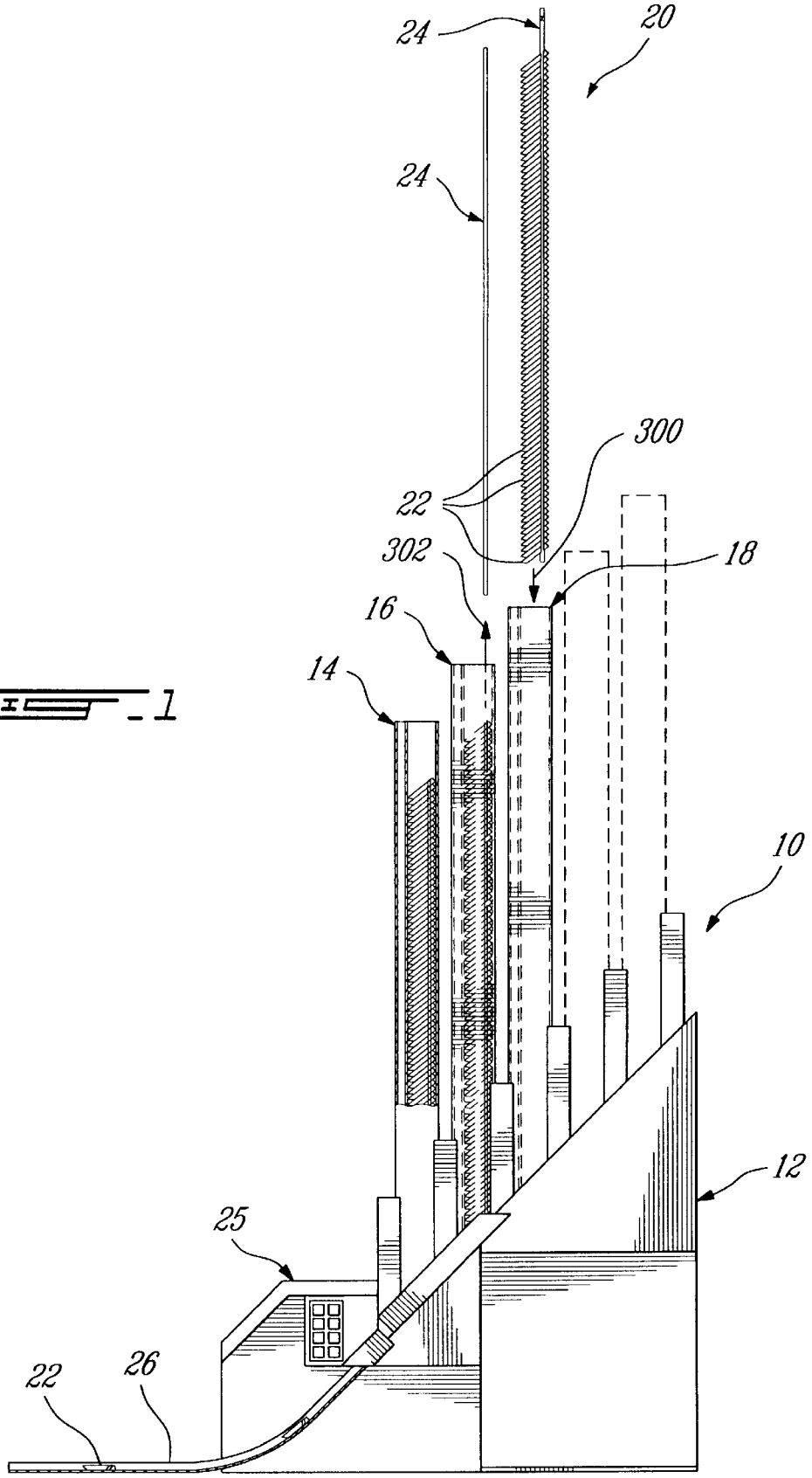
FIG. 1 is an elevational view showing a cassette dispenser with loaders receiving a collective stack arrangement of cassettes and showing the retrieval of a connecting element.

Referring to FIG. 1, there is shown a cassette dispensing and printing unit, generally denoted 10, consisting of a cassette dispenser 12 having a series of vertical cassette distributing loaders, three of which are shown in full lines as 14, 16 and 18. In accordance with the present invention, these loaders are adapted to hold a stack arrangement 20 of cassettes 22 interconnected by a band 24. Although not shown, a wire or string could be used instead of the rectangular band 24 to serve as a connecting element. Whenever a cassette is discharged, a printing unit 25 is provided at the bottom of the dispenser 12 allowing a cassette to be engraved on a face thereof and to be thereafter dispensed on a guiding slide 26. A mechanism (not shown) is provided at the bottom of the dispenser allowing to retrieve the cassettes individually.

Figure 2:
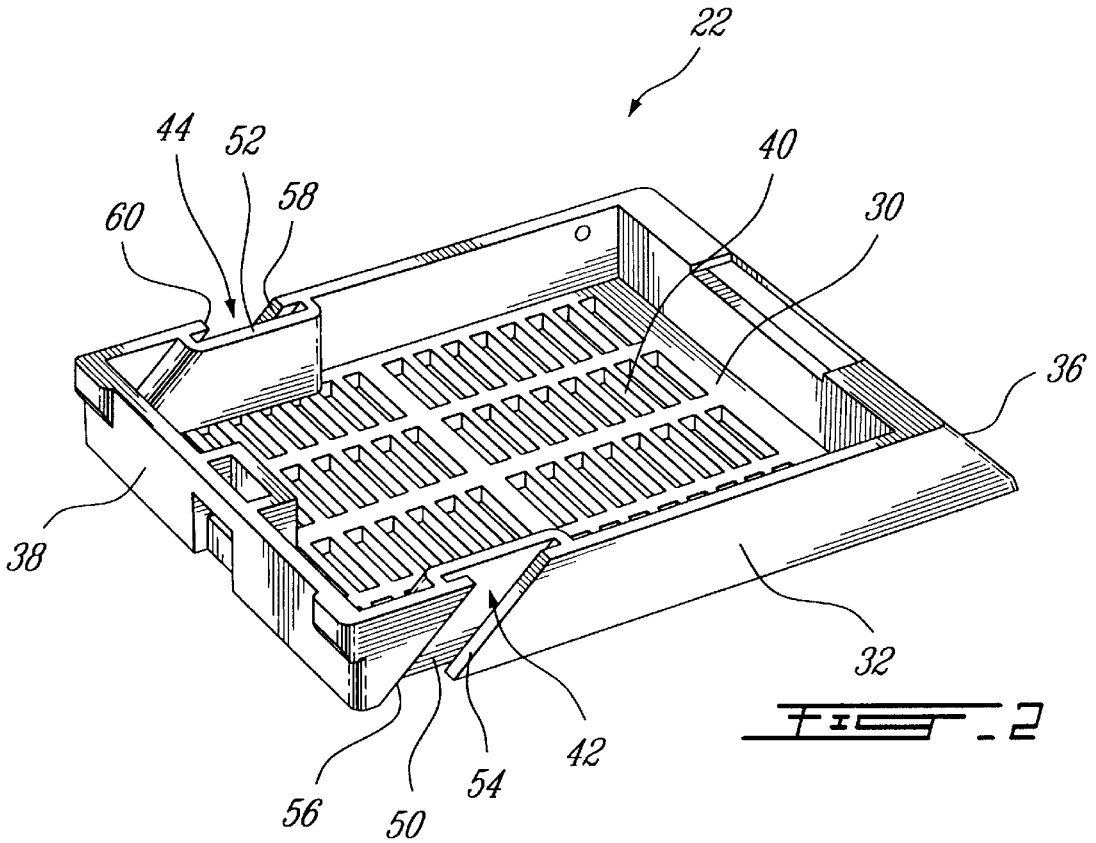
FIG. 2 is a perspective view of a first embodiment of a cassette made in accordance with the present invention.
Figure 3:
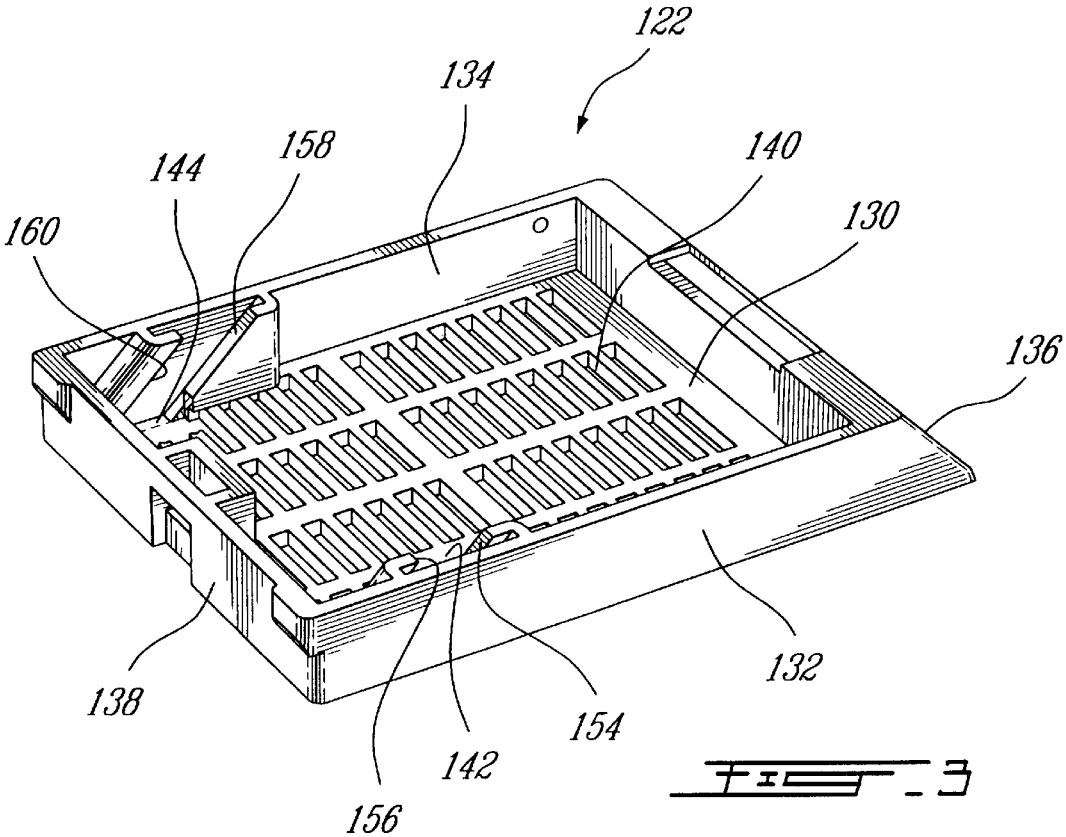
FIG. 3 is a second embodiment of a cassette made in accordance with the present invention.
Figure 4:
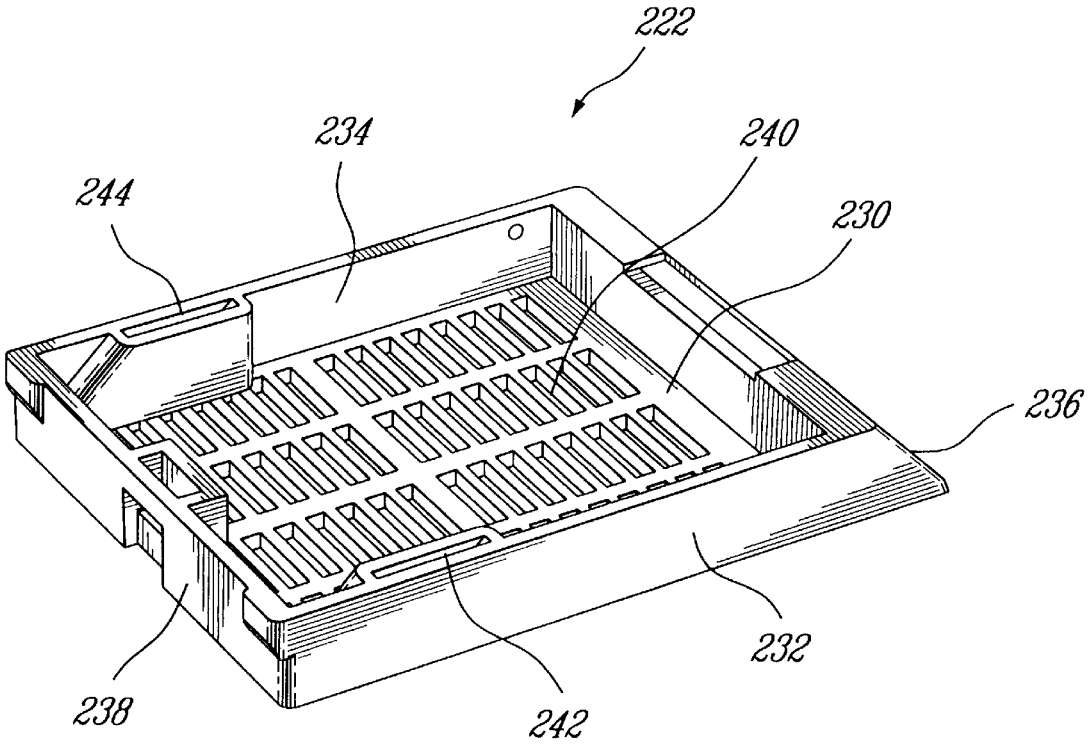
FIG. 4 is a third embodiment of a cassette made in accordance with the present invention.

Referring to FIGS. 2, 3 and 4, three embodiments of a cassette made in accordance with the present invention are illustrated. Although not shown, these cassettes are adapted to receive a covering lid; one example of construction of such cassettes and lids may be found described in Canadian patent application No. 2,117,314 published Dec. 10, 1995 in the name of Lafond et al. A description of the lid adapted to be mounted to and cover the cassette is not considered essential for a full understanding of the present invention; its omission is made to provide better illustration of the cassette.

Referring to FIG. 2, the first embodiment 22 of the cassette comprises a body, usually made of plastics material, having a perforated bottom 30, opposite planar side walls 32 and 34, an inclined front wall 36 and a rear wall 38. The perforations on the bottom wall 30 consist of a series of rectangular openings 40; but, they may also consist of openings having other configuration. In this embodiment, the invention is concerned with providing on the opposite side walls 32 and 34 of the body, channels 42 and 44 which extend at an angle with respect to the horizontal plane of the planar side walls 32 and 34. Each channel has an open top and an open bottom and has a width which is adapted to correspond to the flat rectangular cross section of the elongated band 24 (FIG. 1) which may be slidably received therethrough as further described hereinbelow. Evidently, in cases where the connecting element is a wire or string, the cross-section of the channel will vary.

In this first embodiment, each channel 42 or 44 defines a U-shaped configuration with an inner wall 50 or 52 which is parallel to the side wall 32 or 34. Each channel 42 or 44 is open towards the outside by means of a slot defined by opposite facing edges 54 or 56 and 58 or 60.

FIG. 3 shows a second embodiment 122 of a cassette made in accordance with the present invention. The cassette 122 has a perforated bottom 130, opposite planar side walls 132 and 134, an inclined front wall 136 and a rear wall 138. The bottom has a series of rectangular openings 140. In this embodiment, the channels 142 and 144 extend at an angle on the inner side of side walls 132, 134. Each channel has an open top and an open bottom, the latter extending through the cassette bottom for passage of the connecting band 24.

In this embodiment, the channel 142 or 144 is open towards the inside by means of a slot which is defined by inclined facing edges 154, or 156 and 158 or 160.

Referring to FIG. 4, a third embodiment 222 of a cassette made in accordance with the present invention is shown and is formed of a plastic body having perforated bottom 230, opposite planar walls 232 and 234, an inclined front wall 236 and a rear wall 238. The perforated bottom 230 is formed of a series of rectangular openings 240.

In this embodiment, the channels 242 and 244 are formed on the inside of the opposite side walls 232 and 234; but they are enclosed. The perforated bottom 230 has therefore an elongated opening (not shown) to provide an open bottom for the passage of the connecting band 24 therethrough.

Figure 5:
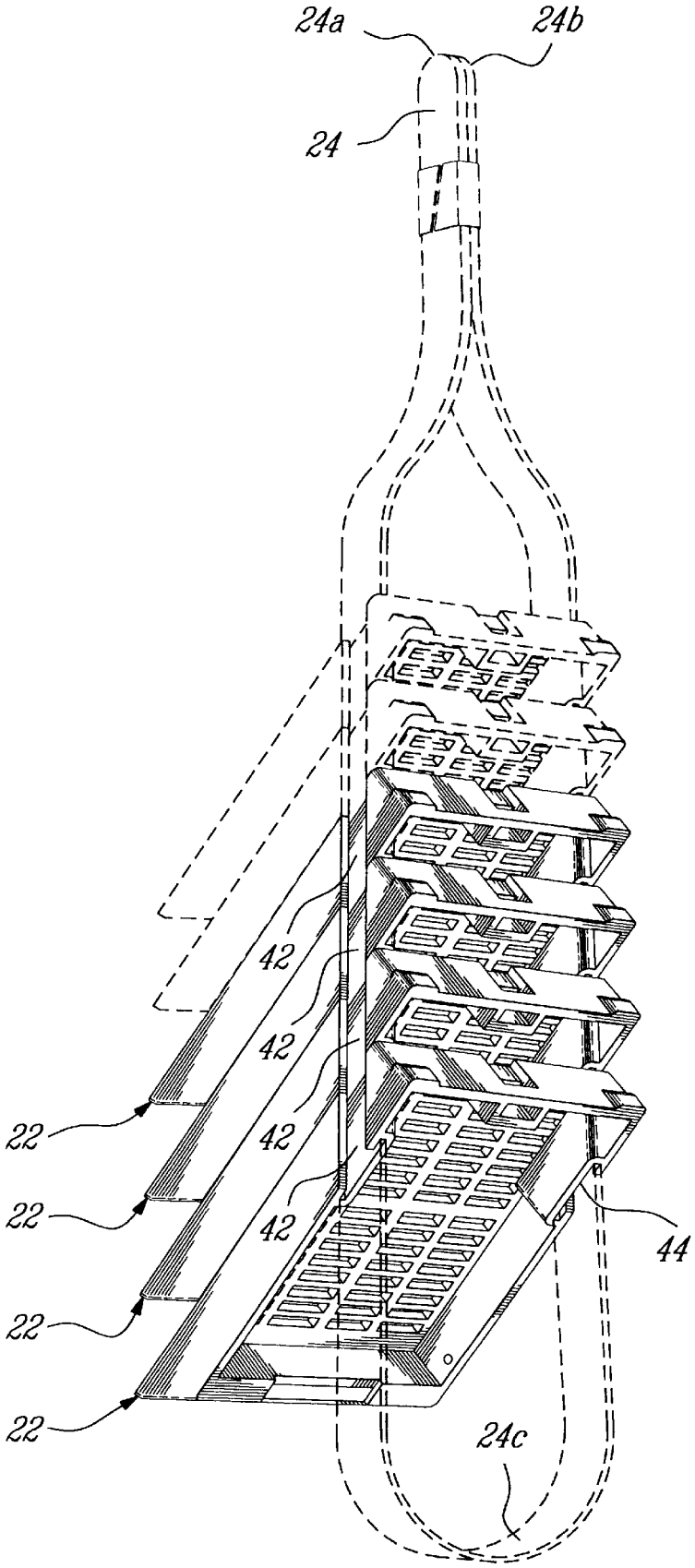
FIG. 5 is a perspective view of a stack arrangement of cassettes with a connecting band shown in dotted lines.

Referring to FIG. 5, a stacked arrangement 20 of cassettes 22 is shown united by the connecting element 24 that extends through the opposite channels 42 and 44 of each cassette. Referring also to FIG. 1, once this stacked arrangement of cassette is formed, the package is inserted as indicated by arrow 300 to slide into one of the vertical loaders 14, 16, 18 of the cassette dispenser 12. Since the slots have an oblique configuration, the stack arrangement is such that the cassettes extend obliquely with respect to a vertical plane. Once the stacked arrangement is properly positioned in the loaders, the connecting band 24 which may have a U-shaped configuration such as shown in dotted lines in FIG. 5 or into a closed loop is cut at 24*c* and is slidably retrieved, such as illustrated by arrow 302, by pulling on its ends 24*a* or 24*b*. The cassettes are now available to be dispensed individually.

Although the invention has been described above with respect to three specific forms, it will be evident to a person skilled in the art that it may be modified and refined in various ways. For example, a channel could be provided on one only of the side walls of the cassette to form a package with a single connecting element extending through all channels. Also, the channel to receive the connecting element could be made on the front wall or on the rear wall. Furthermore, it is not necessary that the channel extends obliquely, if the cassettes are stacked horizontally in the loaders. It is therefore wished to have it understood that the present invention should not be limited in scope, except by the terms of the following claims.

What is claimed is:

1. A biological specimen cassette adapted to be installed with similarly constructed cassettes as a package in a cassette dispenser from which cassettes are dispensed separately; said cassette comprising:

a body having a perforated bottom from which extend front, side and rear walls at least one of said walls displaying a downward channel extending therealong at an oblique angle with respect to the body; said channel having an open top and an open bottom so as to slidably receive therethrough a connecting element for forming, with similarly constructed cassettes, a collective stacked arrangement of cassettes whereby a plurality of cassettes connected by said element extending through said channel of each cassette may be collectively inserted into a cassette dispenser loader; the connecting element being thereafter retrievable to form a stack of separate cassettes individually dispensable from the loader.

2. A biological specimen cassette as defined in claim 1, wherein each of the side walls includes a downward channel extending therealong.

3. A biological specimen cassette as defined in claim 1, wherein said channel extends along the inner face of said side wall; said bottom having an opening therethrough in alignment with said channel for passage of said collecting element therethrough.

4. A biological specimen cassette as defined in claim 1, wherein said channel extends at the outer face of said side wall.

5. A biological specimen cassette as defined in claim 1, wherein said channel defines an enclosed passage.

6. A biological specimen cassette as defined in claim 1, wherein said channel has a U-shaped configuration with a slot extending along an outer face thereof.

7. A biological specimen cassette as defined in claim 1, wherein each said side wall of said body includes a channel.

8. A biological specimen cassette as defined in claim 1, wherein said connecting element is a band.

9. A biological specimen cassette as defined in claim 1, wherein said connecting element is a wire.

10. A biological specimen cassette as defined in claim 1, wherein said connecting element is a string.

11. A biological specimen cassette adapted to be installed with similarly constructed cassettes as a package in a cassette dispenser from which cassettes are dispensed separately; said cassette comprising:

a body having a perforated bottom from which extend front, side and rear walls, at least one of said walls defining a receiving portion; said receiving portion having an open top and an open bottom so as to slidably receive therethrough a connecting element for supporting said cassette body at an oblique angle to the connecting element, and for forming, with similarly constructed cassettes, a collective stacked arrangement of cassettes, whereby a plurality of cassettes connected by said element extending through said receiving portion of each cassette may be collectively inserted into a cassette dispenser loader; the connecting element being thereafter retrievable to form a stack of separate cassettes individually dispensable from the loader.

12. A cassette as defined in claim 11, wherein the receiving portion comprises a downward channel extending at an oblique angle to the body of the cassette.

* * * * *